United States Patent [19]

Wirz

[11] Patent Number: 4,930,414

[45] Date of Patent: Jun. 5, 1990

[54] SHEET FED ROTARY PRINTING PRESS FOR PERFORMING ALTERNATIVELY SINGLE-SIDE MULTICOLOR PRINTING OR FIRST FORM AND PERFECTOR PRINTING

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 426,499

[22] Filed: Oct. 23, 1989

Related U.S. Application Data

[63] Continuation of Ser. No. 197,289, May 23, 1988, abandoned.

[30] Foreign Application Priority Data

May 21, 1987 [DE] Fed. Rep. of Germany ..... 3717093

[51] Int. Cl.[5] ..... B41F 5/02; B41L 15/10

[52] U.S. Cl. ..... 101/183; 101/230

[58] Field of Search ..... 101/183, 184, 177, 230, 101/231, 141, 136, 137, 142, 409–411; 271/197, 225, 82, DIG. 902

[56] References Cited

U.S. PATENT DOCUMENTS 2,931,647 4/1960 Papa et al. ..... 101/230 X
4,165,689 8/1979 Giuiuzza ..... 101/230
4,662,277 5/1987 Fischer ..... 101/230
4,723,489 2/1988 Emrich et al. ..... 101/230

*Primary Examiner*—J. Reed Fisher
*Attorney, Agent, or Firm*—Herbert L. Lerner; Laurence A. Greenberg

[57] ABSTRACT

A sheet-fed rotary printing press for performing alternatively single-side multicolor printing or first form and perfector printing with a sheet transfer cylinder disposed in a direction of travel of a sheet between impression cylinders of two printing units, all of the cylinders having grippers associated therewith, comprising a sheet support disposed downstream from the sheet transfer cylinder in the travel direction of the sheet and having a substantially flat upper support surface located substantially tangentially to the sheet transfer cylinder, the sheet transfer cylinder carrying grippers for grippings a trailing edge of the sheet and being rotatable so as to deposit the sheet on the support surface, with a free leading edge thereof first, as the grippers approach the sheet support, the sheet transfer cylinder being further rotatable beyond the sheet support with the grippers maintaining their grip on the trailing edge of the sheet so that the sheet is lifted from the support surface with the trailing edge thereof leading the leading edge thereof.

10 Claims, 6 Drawing Sheets

SHEET FED ROTARY PRINTING PRESS FOR PERFORMING ALTERNATIVELY SINGLE-SIDE MULTICOLOR PRINTING OR FIRST FORM AND PERFECTOR PRINTING

This application is a continuation, of application Ser. No. 197,289, filed May 23, 1988, now abandoned.

SPECIFICATION

The invention relates to a sheet-fed rotary printing press for performing alternatively single-side multicolor printing or first form and perfector printing, more particularly, with a sheet transfer cylinder disposed in a direction of travel of a sheet between impression cylinders of two printing units; all of the cylinders having grippers associated therewith.

From Japanese Published Prosecuted Application Sho No. 52-29 643, a sheet-fed rotary printing press of the foregoing type is known, in which a storage drum disposed beneath a sheet transfer cylinder located between two impression cylinders is operatively associated with the sheet transfer cylinder. The sheet transfer cylinder contains grippers for gripping the trailing edge of the sheet. Before these grippers close, the trailing edge of the sheet is creased or folded over approximately 90° by a sheet guide plate located towards the side of the storage drum. Such a sheet-fed rotary printing press is not suitable for printing cardboard, however. Furthermore, the storage drum, which is located outside the normal sheet travel path, greatly prevents the setting up or installation of a sheet-fed rotary printing press in an in-line arrangement. Consequently, it is impossible to smooth out the sheet prior to its being taken over by the following grippers, which makes inaccurate printing more likely.

It is an object of the invention, accordingly, to provide a sheet-fed rotary printing press of the foregoing general type which, while having a low structural machine height, affords reliable turning of the sheet, even in the case of relatively thick cardboard.

With the foregoing and other objects in view, there is provided, in accordance with the invention, a sheet-fed rotary printing press for performing alternatively single-side multi-color printing or first form and perfector printing with a sheet transfer cylinder disposed in a direction of travel of a sheet between impression cylinders of two printing units, all of the cylinders having grippers associated therewith, comprising a sheet support disposed downstream from the sheet transfer cylinder in the travel direction of the sheet and having a substantially flat upper support surface located substantially tangentially to the sheet transfer cylinder, the sheet transfer cylinder carrying grippers for gripping a trailing edge of the sheet and being rotatable so as to deposit the sheet on the support surface, with a free leading edge thereof first, as the grippers approach the sheet support, the sheet transfer cylinder being further rotatable beyond the sheet support with the grippers maintaining their grip on the trailing edge of the sheet so that the sheet is lifted from the support surface with the trailing edge thereof leading the leading edge thereof.

In accordance with another feature of the invention, the sheet support is disposed in vicinity of a nip located between the sheet transfer cylinder and one of the impression cylinders located downstream of the sheet transfer cylinder in the travel direction of the sheet, the sheet support being below the one impression cylinder.

In accordance with a further feature of the invention, the sheet transfer cylinder has a peripheral surface overlapping an end of the sheet support extending towards the sheet transfer cylinder.

In accordance with an added feature of the invention, the grippers have gripper jaws and the grippers, after the sheet transfer cylinder has rotated therewith beyond the sheet support, are turnable from a position thereof wherein the gripper jaws extend in the direction of rotation of the sheet transfer cylinder, into a position thereof wherein the gripper jaws extend in a direction opposite to the direction of rotation of the sheet transfer cylinder.

In accordance with an additional feature of the invention, the sheet support is constructed as a revolving belt.

In accordance with again another feature of the invention, the support surface of the sheet support bulges slightly outwardly in a direction towards the impression cylinder.

In accordance with again a further feature of the invention, the grippers of the sheet transfer cylinder are formed as tongs grippers having a gripper arm pivotable through approximately 180° from an open position thereof in which it is lowered into the sheet transfer cylinder into a closed position thereof extending in an opposite direction, towards the trailing edge of the sheet.

In accordance with again an added feature of the invention, the grippers have gripper jaws, and including suction nozzles disposed in front of the gripper jaws for temporarily holding the trailing edge of the sheet.

In accordance with again an additional feature of the invention, the suction nozzles are pivotable in peripheral direction of the sheet transfer cylinder so as to insert the trailing edge of the sheet, held at the leading edge thereof by additional grippers, between the gripper jaws in a direction opposite to the direction of rotation of the sheet transfer cylinder.

In accordance with yet another feature of the invention, the sheet supporting revolving belt has a friction lining.

In accordance with a concomitant feature of the invention, there are provided additional suction nozzles associated with the sheet supporting revolving belt.

A considerable advantage resulting from the invention is that because the sheet support is disposed following or downstream of the sheet transfer cylinder, a low structural height of the printing press or machine is realizable. The sheet support fits into the overall structure of the sheet-fed rotary printing press in a space-saving manner and is well suited for use with in-line arrangement concepts. If the sheet is to be printed on the back thereof after it has passed through the first printing unit, the leading edge of the sheet delivered from the sheet transfer cylinder onto the upper surface of the sheet support and, during the approach of the grippers which hold the trailing edge of the sheet, is pushed farther onto the sheet support. As the sheet transfer cylinder rotates further, the sheet advances with its trailing edge, which is gripped by the grippers, in a leading position, thereby turning over the sheet. The sheet turning or turn-over can be performed reliably and accurately, in conjunction with good printing results. The sheet-fed rotary printing press according to the invention also is well suited for processing cardboard. Moreover, high sheet-travel speeds through the printing press or machine can be attained, which makes the sheet-fed rotary printing press very economical. Particularly good transfer of the leading edge of the sheet to the sheet support and pushing or sliding the corresponding starting end of the sheet onto the sheet support, respectively, is attained by disposing the sheet support in or in the vicinity of the nips between the sheet transfer cylinder and the impression cylinder which follows i.e. which is downstream from the sheet transfer cylinder in travel direction of the sheet, the sheet support being disposed beneath the impression cylinder. Furthermore, the space which is available there is utilized for accommodating this sheet support. Because the circumferential or peripheral surface of the sheet transfer cylinder overlaps the end of the sheet support extending towards the sheet transfer cylinder by a given amount, an additional sheet displacement component is produced, which leads to an acceleration of the sheet displacement onto the sheet support. Creasing or folding of the trailing edge of the sheet is reliably avoided during the turning process because the corresponding grippers of the sheet transfer cylinder, after traveling past a position opposite the sheet support end extending towards the sheet transfer cylinder, pivot from the position in which the gripper jaws extend in a direction of rotation of the sheet transfer cylinder to a position in which the gripper jaws extend in a direction opposite to the direction of rotation of the sheet transfer cylinder. The gripper jaws therefore always extend in the direction of the plane of the sheet and preclude folding or creasing of the trailing end of the sheet, while assuring reliable transfer of the trailing edge of the sheet to the grippers of the following impression cylinder. The front edge of the sheet is applied more firmly to the sheet support because the sheet support is constructed as a revolving belt. The direction with which the belt revolves preferably corresponds to the direction of the sheet transfer cylinder at their mutually adjacent locations. The speed of the belt also corresponds to the circumferential or peripheral speed of the sheet transfer cylinder. The engagement of the trailing edge of the sheet by the sheet support is optimized by providing that the upper surface of the sheet support extends convexly or bulging upwards slightly in the direction towards the impression cylinder. An advantageous possibility of reliably gripping the trailing edge of the sheet is provided by forming the gripper as tongs grippers having a gripper arm pivotable through approximately 180° from an open position thereof in which it is lowered into the sheet transfer cylinder into a closed position thereof extending in an opposite direction towards the trailing edge of the sheet. The resultant gripper mouth or jaws can execute the prescribed pivoting movement during the sheet turning or turnover process, in order to avoid creasing or folding of the trailing edge of the sheet. The suction nozzles disposed in front of the jaws of the grippers of the sheet transfer cylinder assure that the grippers moving into the closed position thereof are always capable of reliably gripping the trailing edge of the sheet. If the suction nozzles are also disposed so as to be pivotable in the circumferential or peripheral direction of the sheet transfer cylinder, then it is even possible to introduce with them the trailing edge of the sheet between the gripper jaws of the gripper facing towards it. After suction is applied to the trailing edge of the sheet, the suction nozzles pivot initially in the circumferential or peripheral direction of the sheet transfer cylinder, thereby forming a slight loop or bow in the sheet held at the leading edge thereof by the additional grippers. Thereafter, the suction nozzles pivot back again and push the trailing edge of the sheet between the opened jaws of the grippers, an action which is associated with smoothing of the sheet. This optimally fixes the trailing edge of the sheet for the ensuing sheet turning or turnover process. Improved adhesion between the sheet support and the sheet is attained by providing the sheet support with a friction lining. Instead of such a friction lining, suction nozzles can also be associated with the sheet supporting belt. It is also possible to provide the belt with chain gripper systems. In any case, assurance is always provided that the leading edge of the sheet is optimally transported by the sheet support.

Other features which are considered as characteristic for the invention are set forth in the appended claims.

Although the invention is illustrated and described herein as embodied in a sheet-fed rotary printing press for performing alternatively single-sided multicolor printing or first form and perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic side elevational view of a sheet-fed rotary printing press in an in-line arrangement, wherein three printing units are shown disposed one following the other;

FIG. 2 is an enlarged fragmentary, diagrammatic partly-sectional view of FIG. 1 showing a sheet transfer cylinder disposed between first and second impression cylinders and set for first form and perfector printing in a phase of operation thereof wherein a sheet is held at a leading edge thereof by additional grippers and at a trailing edge thereof by suction nozzles, after the sheet has been transferred from the first impression cylinder;

Figure 4:
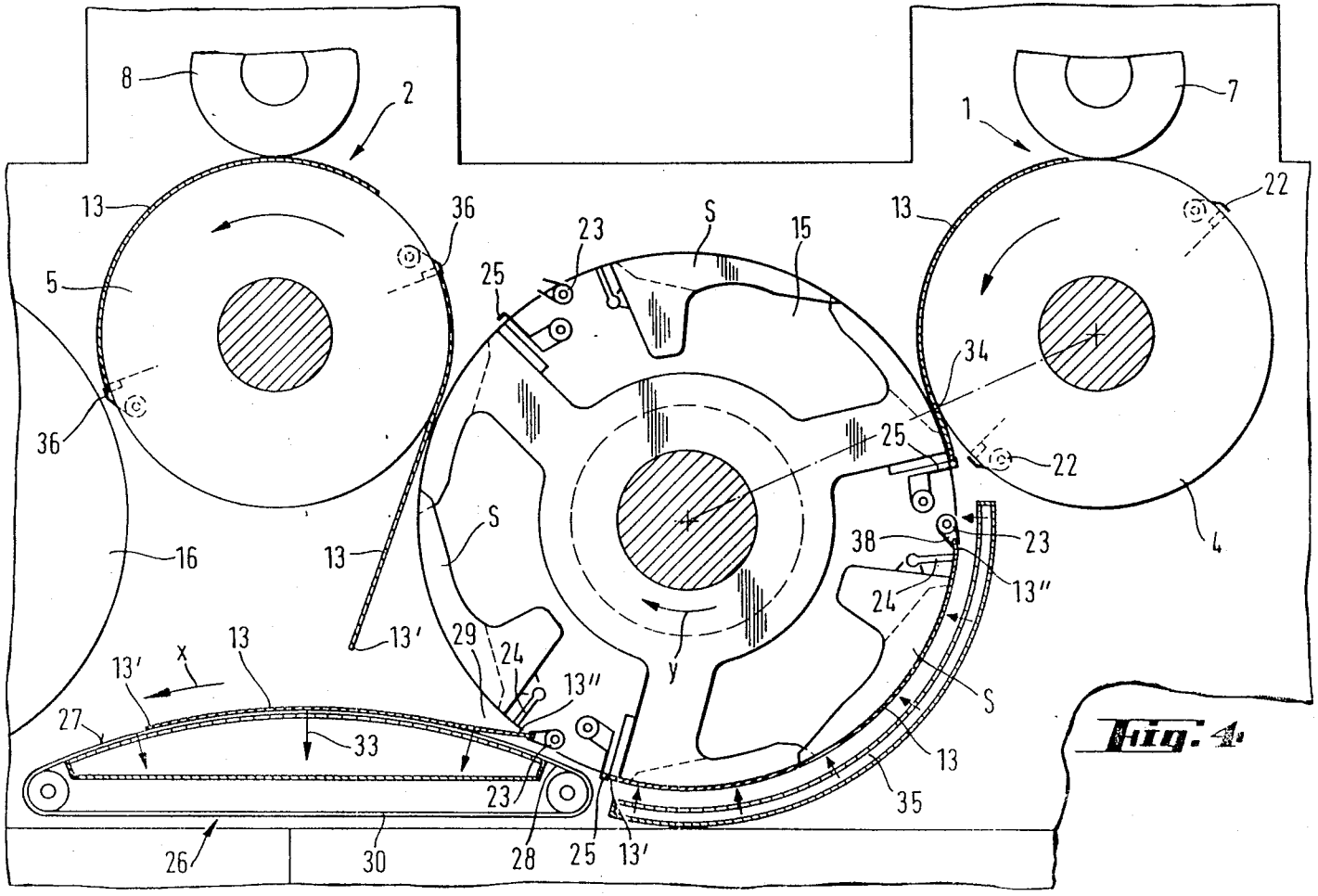
FIG. 4 is a view similar to that of FIG. 3, in a third phase of operation following the phase of FIG. 3, wherein the suction nozzles have been pivoted back again and the trailing edge of the sheet has been inserted into the jaws of the grippers just prior to the opening of the additional grippers holding the leading edge of the sheet.
Figure 8:
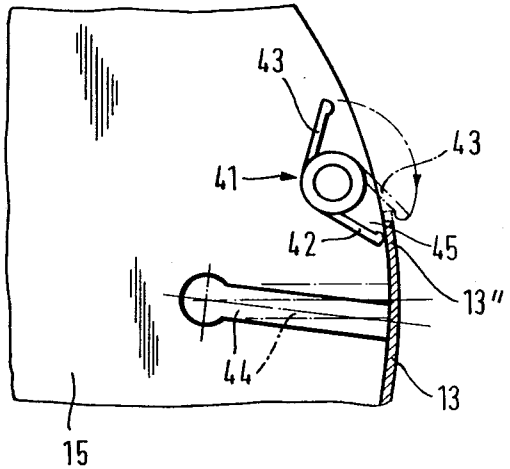
Figure 6:
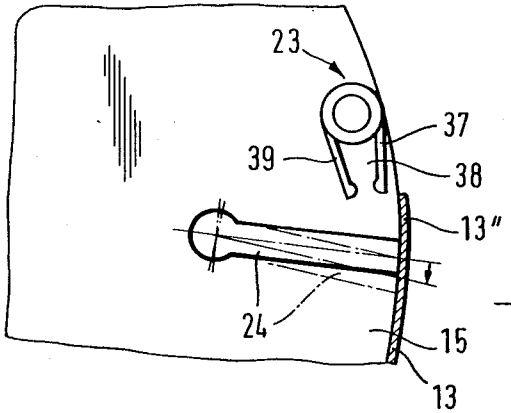
FIG. 6 is an enlarged fragmentary view of FIG. 3 in the vicinity of the suction nozzles holding the trailing edge of the sheet during the application of suction thereto and the forming of a bulge therein.
Figure 7:
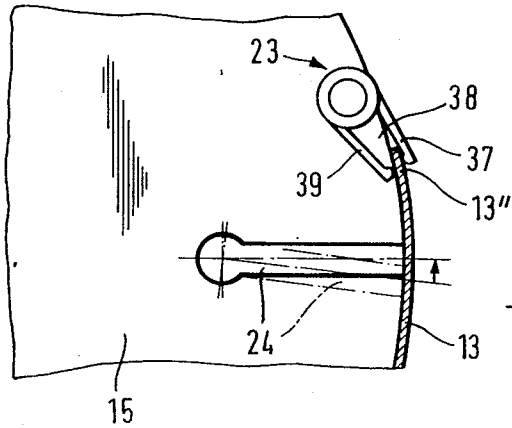

FIG. 7 is an enlarged fragmentary view of FIG. 4 which is similar to the view of FIG. 6 but wherein the sheet is held taut against the cylinder surface i.e. without a bulge, and the trailing edge of the sheet is received between the jaws of the gripper; and FIG. 8 is another view like those of FIGS. 6 and 7 showing a modified embodiment of the gripper which has a gripper arm or jaw thereof which pivots, through approximately 180 degrees from a depressed position thereof shown in solid lines to a closed position thereof shown in phantom, towards the trailing edge of the sheet.

Figure 1:
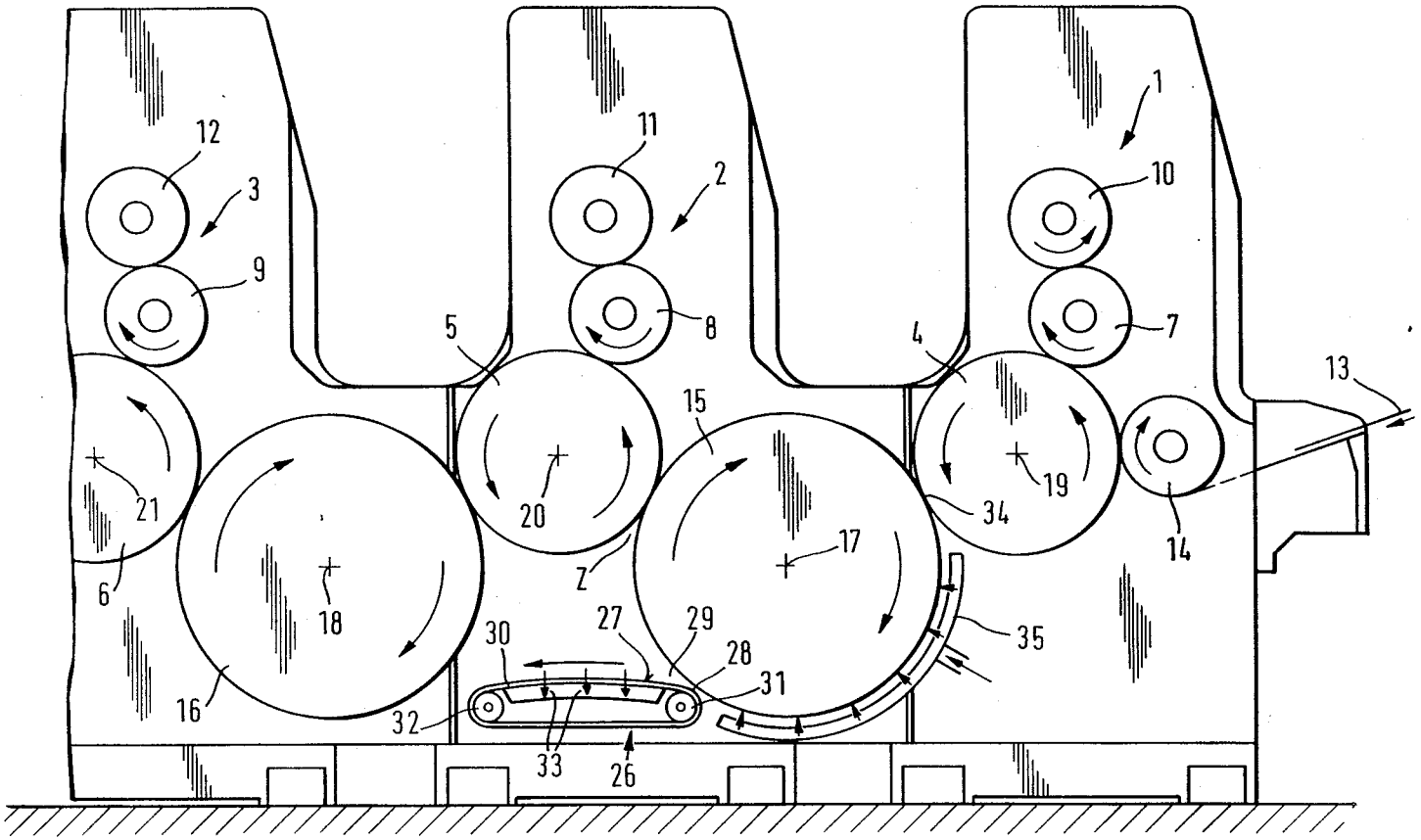

Referring now to the drawing and, first, particularly to FIG. 1 thereof, there is shown diagrammatically a sheet-fed rotary printing machine having several printing units 1, 2 and 3 disposed in tandem i.e. one behind the other. Each printing unit includes a respective impression cylinder 4, 5, 6, a respective blanket cylinder 7, 8, 9 and a respective plate cylinder 10, 11, 12. Inking units which are associated with the plate cylinders 10, 11 and 12 are not illustrated in the interest of clarity.

Sheets 13 which are to be printed are fed in a conventional manner to the impression cylinder of the first printing unit 1 by a feeder drum 14 located at the entry or incoming side of the machine.

A sheet transfer cylinder 15 is disposed between the impression cylinders 4 and 5, respectively, of the first two printing units 1 and 2. Another sheet transfer cylinder 16 is disposed between the impression cylinders 5 and 6. The sheet transfer cylinders 15 and 16 have respective axes of rotation 17 and 18 located underneath axes 19, 20 and 21, respectively, of the impression cylinders 4, 5 and 6. The sheet transfer cylinders 15 and 16 have respective diameters which are three times as great as those of the blanket cylinders 7, 8 and 9. The impression cylinders 4, 5 and 6, contrarily, have respective diameters which are twice as large as those of the blanket cylinders 7, 8 and 9, respectively. Accordingly, the impression cylinders 4, 5 and 6 can each receive two sheets 13 in succession.

Two rows of clamping grippers 22 (FIG. 2), disposed diametrically opposite one another on the impression cylinder 4, are provided for holding the sheets 13 on the impression cylinder 4 of the first printing unit 1. As further shown in FIG. 2, the sheet transfer cylinder 15 engaging the first impression cylinder 4 is equipped with three tongs-like grippers 23 arranged with equal angular distribution about the periphery thereof. In the direction of rotation of the sheet transfer cylinder 15, as represented by the curved arrow y, suction nozzles 24 which are pivotally mounted about the periphery of the sheet transfer cylinder 15, are located adjacent these tongs grippers 23 The suction nozzles 24 are seated on three segments S, which are adjustably disposed about the periphery of the sheet transfer cylinder 15 and are received in recesses formed in the sheet transfer cylinder 15, the segments S having back surfaces which are flush with and close the periphery of the sheet transfer cylinder 15. At the side of the tongs grippers 23 located opposite the suction nozzles 24, the sheet transfer cylinder 15 is also provided with three rows of additional grippers 25, disposed adjacent the tongs grippers 23, and likewise arranged at like or equal intervals about the periphery of the cylinder 15.

A sheet support 26 is arranged following the sheet transfer cylinder 15. The sheet support 26 has a substantially flat arcuate upper surface 27 disposed somewhat tangentially to the outer cylindrical surface of the sheet transfer cylinder 15. The sheet support 26 is disposed in a horizontal plane below the impression cylinder 5 which follows the sheet transfer cylinder 15 and in vicinity of a nip Z formed between the sheet transfer cylinder 15 and the impression cylinder 5. The cylindrical peripheral surface of the sheet transfer cylinder 15 overlaps an end 28 of the sheet support 26 and likewise forms therewith another nip 29.

The sheet support 26 is constructed as a revolving belt 30. For the purpose of guiding the belt 30, two deflecting or reversing rollers 31 and 32 are provided at looping ends thereof. One or both of the rollers 31, 32 may be driven so as to transport or convey the belt 30 in a conveying direction represented by the arrow x, which coincides with the direction of rotation of the sheet transfer cylinder 15 represented by the arrow y. The transport speed of the belt 30 is equivalent to the circumferential or peripheral speed of the sheet transfer cylinder 15. The supporting upper surface 27 formed by the belt 30 extends arcuately i.e. upwardly convex, in a direction towards the impression cylinder 5. To this end, non-illustrated additional rollers forming suitable deflection points may be provided. For processing cardboard, only one suitable guide plate would be sufficient as a sheet support, depending upon the given stiffness of the cardboard sheet.

In FIGS. 1 to 5, arrows 33 diagrammatically represent suction nozzles associated with the sheet-supporting belt 30. It is also possible, however, to provide the sheet-supporting belt 30 with a suitable friction layer. A point of contact 34 between the first impression cylinder 4 and the sheet transfer cylinder 15 is followed by a blowing air nozzle 35 constructed in the form of a circular or curved segment. This air blower nozzle 35 is used whenever the sheets 13 are formed of paper i.e. not stiff cardboard.

In order to remove the sheet 13 from the sheet transfer cylinder 15, the impression cylinder 5 located downstream from the sheet transfer cylinder 15 is likewise equipped with two rows of clamping grippers 36 disposed diametrically opposite one another.

Operation of the sheet-fed rotary printing machine according to the invention occurs in the following manner: As shown in FIGS. 2 to 7, the sheet-fed rotary printing press is set for first form and perfector printing. The sheet 13 transferred from the feeder drum 14 (FIG. 1) to the impression cylinder 4 is gripped at a leading edge 13' thereof by a row of clamping grippers 22 and, after suitably passing through the system, is given a first printing on a front side thereof i.e. a first form printing. As the rotational movement progresses, the leading edge 13' of the sheet 13 reaches the vicinity of a row of the additional grippers 25 of the sheet transfer cylinder 15 which, in the clamping position thereof, move towards the leading edge 13' of the sheet 13. The sheet 13 is thereby entrained by the sheet transfer cylinder 15 in the direction of rotation y thereof. The suction nozzles 24, respectively, then come into action and affix the trailing edge 13" of the sheet to the cylindrical surface of the transfer cylinder 15 (note FIGS. 2 and 6). In this position, the trailing edge 13" of the sheet 13 is located in front or forward of the gripper jaws 38 of the tongs grippers 23 which face in the direction of rotation y of the sheet transfer cylinder 15 and are formed of an outer gripper arm 37 and an inner gripper arm 39 disposed opposite thereto (FIG. 3). As shown in FIG. 6, the outer gripper arm 37 does not project beyond the circumferential surface of the sheet transfer cylinder 15.

Figure 2:
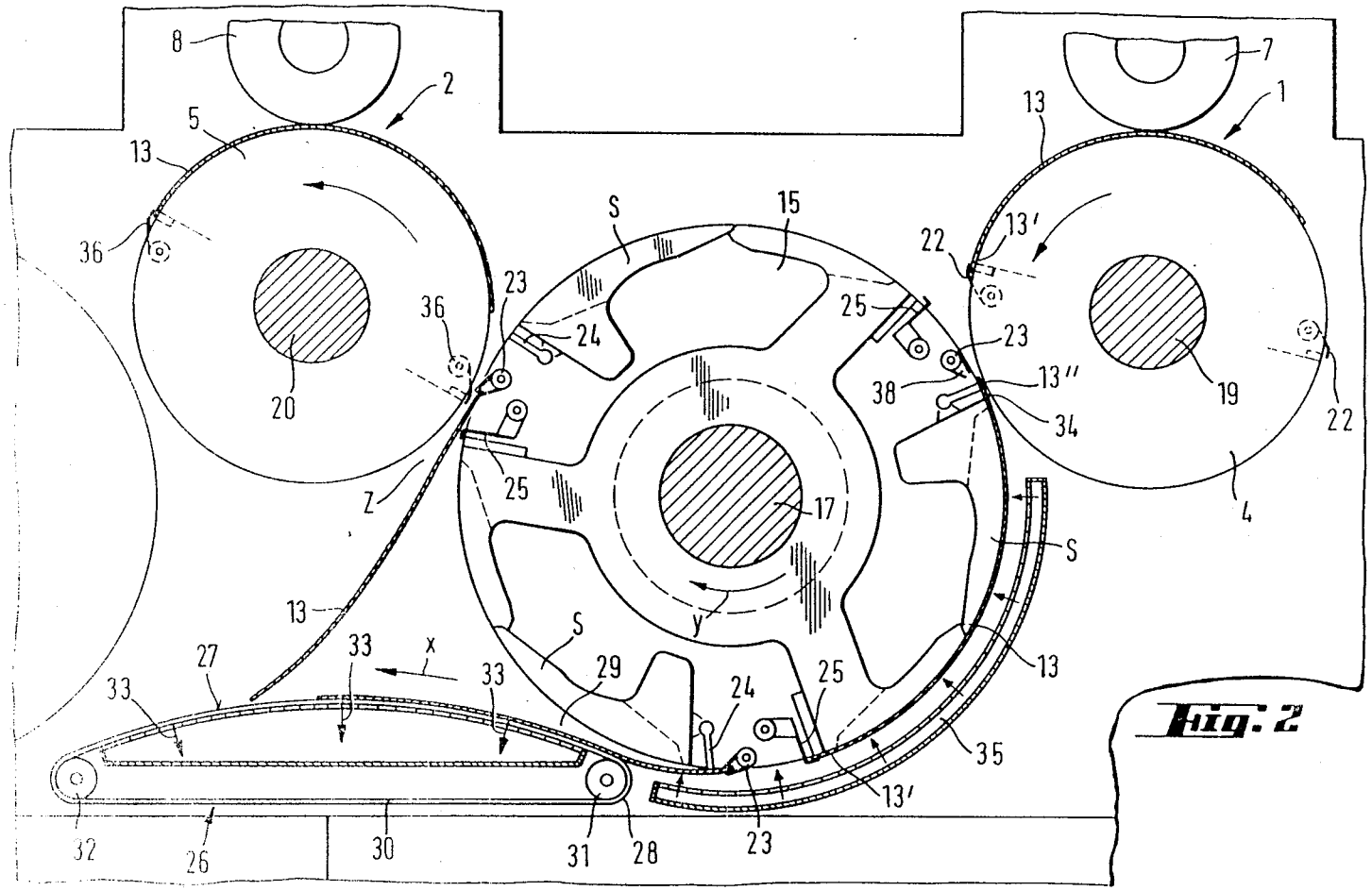
Figure 3:
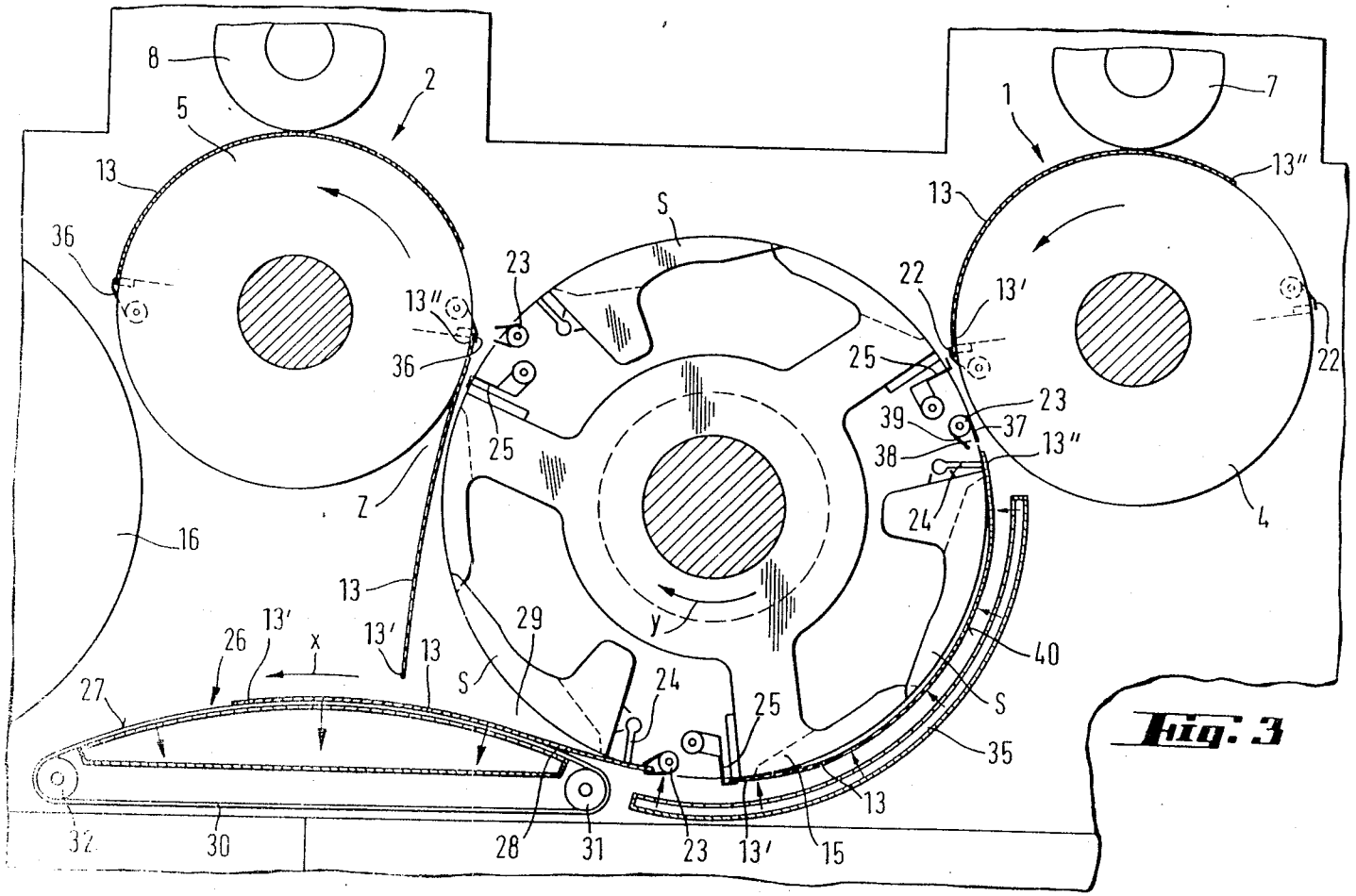
FIG. 3 is a view similar to that of FIG. 2, in another phase of operation after a partial rotation of the sheet transfer cylinder has occurred, wherein the suction nozzles associated with the trailing edge of the sheet have pivoted in the direction of rotation of the sheet transfer cylinder.

In the course of a further partial rotation of the sheet transfer cylinder 15 from the phase position shown in FIG. 2 to the phase position illustrated in FIG. 3 by solid lines and in FIG. 6 in phantom, the trailing edge 13" of the sheet 13 is entrained by the consequent pivoting of the suction nozzles 24 in the direction of rotation y of the sheet transfer cylinder 15. Accompanying this shift in position of the suction nozzles 24 is a buckling or bowing of the sheet 13 so as to form a loop 40 due to the fact that the leading edge 13' of the sheet is held tightly by the additional grippers 25.

Figure 5:
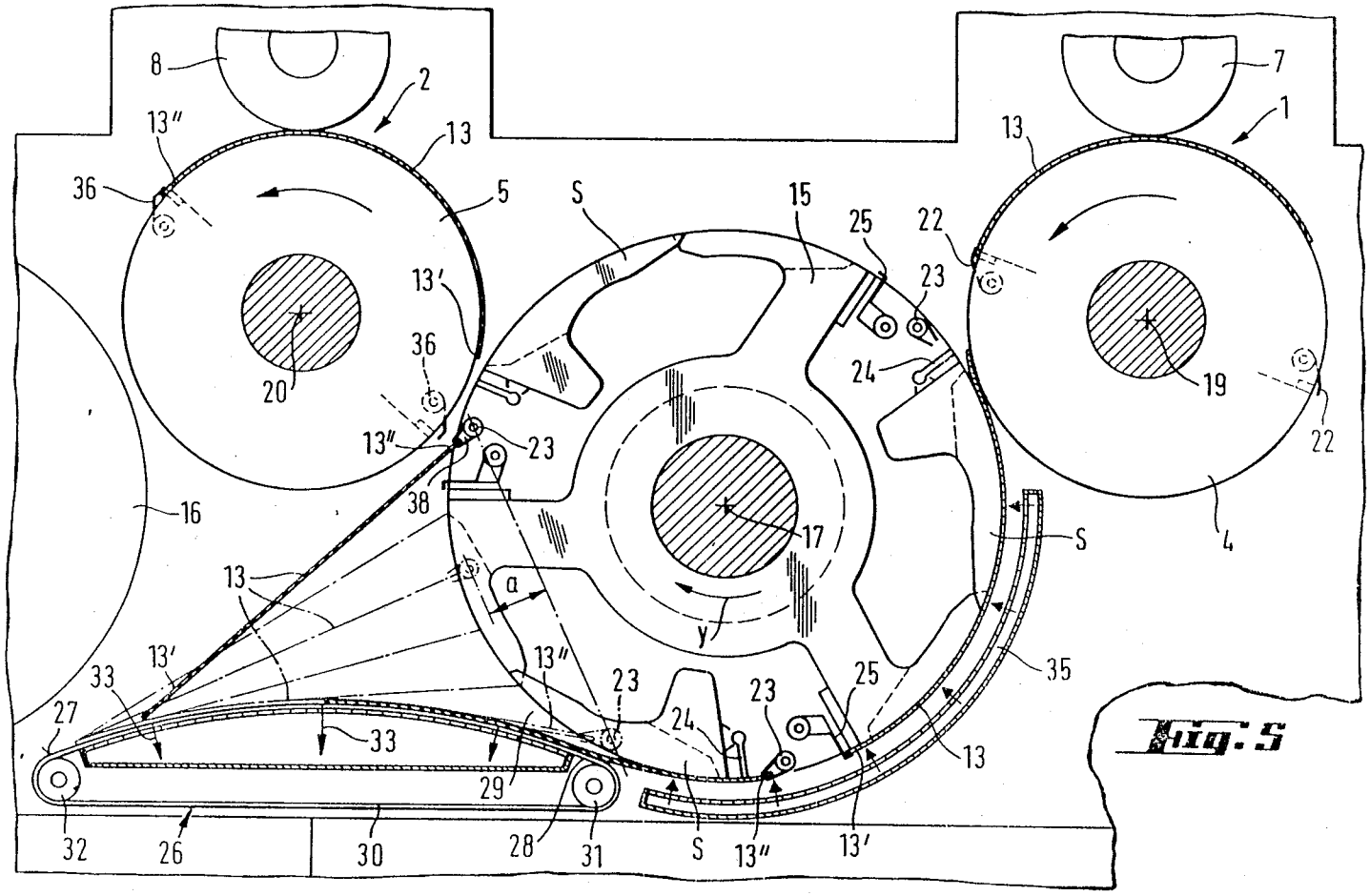
FIG. 5 is a view similar to that of FIG. 4, in a fourth phase of operation following that of FIG. 4, and wherein the sheet has run onto a sheet support during a sheet-turning operation, with simultaneous pivoting of the grippers.

As the sheet transfer cylinder 15 rotates farther, the phase position thereof shown in FIGS. 4 and 7 is attained. During the course of this rotation, the suction nozzles 24 have pivoted back again and in so doing have inserted the trailing edge 13" of the sheet 13 between the gripper jaws 38 of the tongs grippers 23, which have been pivoted outwardly through a small angle, the grippers 23 then having closed. After a further partial rotation, the additional grippers 25 which have reached the vicinity of the sheet support 26 are in a phase position wherein they are open and release the leading edge 13' of the sheet. The leading edge 13' of the sheet thereby comes into contact with the upper support surface 27 of the belt 30, and is accordingly supported, lying flat. As the tongs grippers 23 gripping the trailing edge 13" of the sheet approach the end of the sheet support near the sheet transfer cylinder 15, the sheet 13, with its free or released leading edge 13' leading, is pushed onto the sheet support 26. This pushing action is reinforced by the transport or conveying movement of the belt 30 itself. The position of the tongs grippers 23 shown in phantom in FIG. 5 is then attained, in which the gripper jaws 38 point in the direction of rotation y of the sheet transfer cylinder 15. The tongs grippers 23 then, after moving past a position in which it faces towards the end 28 of the sheet support 30, performs a turning movement so that its gripper jaws 38 are oriented opposite to the direction of rotation y of the sheet transfer cylinder 15; note the position thereof shown in solid lines in FIG. 5. During this process, the sheet 13 is turned over without causing the trailing edge 13" of the sheet to undergo any bending or folding. It is then also apparent from FIG. 5 that, due to the overlapping by the end 28 of the sheet support 30 over part of the circumferential or peripheral surface of the sheet transfer cylinder 15, an additional displacement path a is created, which leads to an acceleration of the sheet on the sheet support 26.

After further partial rotation of the sheet transfer cylinder 15, the trailing edge 13" of the sheet 13 reaches the vicinity of corresponding clamping grippers 36 of the second impression cylinder 5, which take over the trailing edge 13" from the tongs grippers 23. This operative step can be seen in FIGS. 2 and 3. Because the trailing edge 13" of the sheet is not damaged or creased, this transfer can always be performed free of any trouble i.e. without malfunction, so that the sheet 13 can then be printed on the reverse side thereof between the blanket cylinder 8 and the impression cylinder 5.

FIG. 8, which relates to the modified embodiment, shows the tongs grippers 41. They have an inner gripper arm 42 and an outer gripper arm 43. The outer gripper arm 43, prior to moving past the point of contact 34 (note FIG. 4) between the first impression cylinder 4 and the sheet transfer cylinder 15, is in an open position wherein it has been lowered into the sheet transfer cylinder 15. The trailing edge 13" of the sheet 13 is sucked and held by the suction nozzle 44. Then, the suction nozzles 44 pivot through a relatively small rotational angle, counter to the direction of rotation of the sheet transfer cylinder 15, out of the position shown in solid lines and into the position shown in phantom, while stretching or tensioning and smoothing the sheet. The outer gripper arm 43 then closes, as indicated by the arrow, fastening the trailing edge 13" of the sheet 13 within the gripper jaws 45 i.e. between the two gripper arms 42 and 43. The tongs grippers 41 are also arranged so that, as in the embodiment described hereinbefore, they execute a pivoting motion so that the gripper jaws 45 are always located in the plane of the sheet 13 when the sheet is being turned over.

To prevent smearing of the wet ink, the surface of the sheet transfer cylinder 15 is rough and chrome-plated. The other sheet transfer cylinder 16 may have an equivalent construction. If necessary, it may also cooperate with a suitable sheet support.

I claim:

1. A sheet-fed rotary printing press for performing alternatively single-side multicolor printing or first form and perfector printing with a sheet transfer cylinder disposed in a direction of travel of a sheet between impression cylinders of two printing units, all of the cylinders having first grippers mounted on the cylinders at the periphery thereof for releasably gripping a leading edge of the sheet, comprising a sheet support disposed downstream from the sheet transfer cylinder in the travel direction of the sheet and having an upper support surface in the form of an arc with a diameter greater than that of the sheet transfer cylinder, said sheet support comprising a revolving belt in the form of an elongated loop extending substantially tangentially to the sheet transfer cylinder, said loop having a respective upper and lower run spaced from one another a relatively smaller distance in comparison with the length of said elongated loop, the sheet transfer cylinder carrying second grippers at the periphery thereof having means for gripping a trailing edge of the sheet, the sheet transfer cylinder being rotatable and the first grippers being actuatable for releasing the leading edge of the sheet so as to deposit the sheet on said support surface, with a free leading edge thereof first, as said second grippers approach said sheet support, the sheet transfer cylinder being further rotatable beyond said sheet support with said gripping means of said second grippers maintaining their grip on the trailing edge of the sheet so that the sheet is lifted from said support surface with the trailing edge thereof leading the leading edge thereof.

2. A sheet-fed rotary printing press according to claim 1, wherein said sheet support is disposed in vicinity of a nip located between the sheet transfer cylinder and one of the impression cylinders located downstream of the sheet transfer cylinder in the travel direction of the sheet, said sheet support being below the one impression cylinder.

3. A sheet-fed rotary printing press according to claim 2, wherein the sheet transfer cylinder has a peripheral surface overlapping an end of the sheet support extending towards said sheet transfer cylinder.

4. A sheet-fed rotary printing press according to claim 3, wherein said second grippers have gripper jaws, and including means for turning said second grippers from a position thereof wherein said gripper jaws extend in the direction of rotation of the sheet transfer cylinder, into a position thereof wherein said gripper jaws extend in a direction opposite to the direction of rotation of the sheet transfer cylinder, after the sheet transfer cylinder has rotated with said second grippers beyond said sheet support.

5. A sheet-fed rotary printing press according to claim 2, wherein said arcuate support surface of said sheet support extends convexly outwardly in a direction towards the one impression cylinder.

6. A sheet-fed rotary printing press according to claim 1, wherein said second grippers of the sheet transfer cylinder are formed as tongs grippers having a gripper arm, and including means for pivoting said gripper arm through approximately 180° from an open position thereof in which it is lowered into the sheet transfer cylinder into a closed position thereof extending in an opposite direction, towards the trailing edge of the sheet.

7. A sheet-fed rotary printing press according to claim 1, wherein said second grippers have gripper jaws, and including suction nozzles disposed in front of said gripper jaws for temporarily holding the trailing edge of the sheet.

8. A sheet-fed rotary printing press according to claim 8, including means for pivoting said suction nozzles in peripheral direction of the sheet transfer cylinder so as to insert the trailing edge of the sheet, held at the leading edge thereof by said first grippers, between said gripper jaws in a direction opposite to the direction of rotation of the sheet transfer cylinder.

9. A sheet-fed rotary printing press according to claim 1, wherein said sheet supporting revolving belt has a friction lining.

10. A sheet-fed rotary printing press according to claim 1, including suction nozzles associated with said sheet supporting revolving belt.

* * * * *